US006806413B1

(12) United States Patent
Chidlaw et al.

(10) Patent No.: US 6,806,413 B1
(45) Date of Patent: Oct. 19, 2004

(54) OSCILLATOR PROVIDING WAVEFORM HAVING DYNAMICALLY CONTINUOUSLY VARIABLE WAVESHAPE

(75) Inventors: Robert Chidlaw, Westford, MA (US); Ralph Muha, Cambridge, MA (US)

(73) Assignee: Young Chang Akki Co., Ltd., Inchon (KR)

( * ) Notice: Subject to any disclaimer, the term of this patent is extended or adjusted under 35 U.S.C. 154(b) by 0 days.

(21) Appl. No.: 10/208,953

(22) Filed: Jul. 31, 2002

(51) Int. Cl.[7] ..... G10H 1/08; G10H 5/00

(52) U.S. Cl. ..... 84/660; 84/604; 84/622; 84/625; 84/659; 84/671; 84/692; 84/697

(58) Field of Search ..... 84/600–610, 615–617, 84/622–627, 649–650, 653–655, 659–663, 671–673, 692–694, 697–702

(56) References Cited

U.S. PATENT DOCUMENTS 5,194,684 A 3/1993 Lisle et al.
5,504,270 A * 4/1996 Sethares ..... 84/645
5,541,354 A 7/1996 Farrett et al.
5,604,323 A 2/1997 Hardie-Bick
5,644,098 A 7/1997 Jenkins et al.
5,665,929 A 9/1997 Dong et al.
5,698,805 A * 12/1997 Thompson et al. ..... 84/615
5,834,672 A * 11/1998 Wang ..... 84/660
5,900,568 A * 5/1999 Abrams ..... 84/622
5,900,570 A * 5/1999 Rossum ..... 84/653
6,445,790 B1 * 9/2002 Burgan et al. ..... 379/361

* cited by examiner

*Primary Examiner*—Marlon Fletcher
(74) *Attorney, Agent, or Firm*—Cesari and McKenna, LLP

(57) ABSTRACT

An oscillator for digital music synthesis that provides a smooth waveform that is rich in harmonic content and whose shape is continuously and dynamically variable over a wide range of harmonically rich shapes. The oscillator is efficient in that it generates the shapes in a time consonant with sampling rates commonly used in music synthesis, and is generally free of discontinuities which would otherwise create audible alias components on subsequent signal processing.

17 Claims, 12 Drawing Sheets

(n=0.01)

(n=0.1)

(n=1)

(n=10)

(n=100)

(n=0.01)

(n=0.1)

(n=1)

(n=10)

(n=100)

OSCILLATOR PROVIDING WAVEFORM HAVING DYNAMICALLY CONTINUOUSLY VARIABLE WAVESHAPE

BACKGROUND OF THE INVENTION

1. Field of the Invention

The inventions relates to oscillators for use in music synthesizers, and comprises an oscillator providing a smooth waveform rich in harmonic content whose shape is continuously and dynamically variable over a wide range of harmonically rich shapes.

2. Background Information

Oscillators play a central role in music synthesis. In general, they provide a basic waveshape, or components or prototypes of a desired waveshape, which are then further processed to achieve the desired shape. For example, in additive (Fourier) synthesis, oscillators are commonly used to generate the constituents of a wave which, when added together, produce the desired waveshape. In subtractive synthesis, oscillators provide a prototype or basic wave which is then further processed, e.g., by filtering and the like to remove some constituents and enhance others, to thereby form the desired waveshape.

Sawtooth waveforms provide a rich source of signals for creation of electronic music by means of subtractive synthesis techniques. Such signals can be generated digitally by repeatedly adding a phase increment to an accumulator at the frequency of the sawtooth to be generated. Sawtooth waves are rich in harmonic content, which makes them especially desirable for subtractive synthesis. However, because of this content, they pose significant problems with respect to the creation of undesired alias images, and significant filtering is often required to prevent this aliasing. Filtering is expensive in digital circuitry in terms of both processing power and processing time required for effective filtering, and this restricts the capabilities otherwise provided by sawtooth wave generation. See, e.g., U.S. Pat. No. 5,194,684, "Method and Apparatus For Selective Reduction of Upper Harmonic Content In Digital Synthesizer Excitation Signals", issued May 16, 1993 to the International Business Machines Corporation.

Wavetable (phase increment or phase accumulator) oscillators are frequently used to generate waveshapes of desired form and frequency. In such oscillators, the amplitude coefficients of a single cycle of a basic waveshape are stored in a random access memory, and are read out of the memory at a rate dependent of the desired frequency or pitch of the note to be played. The stored waveshape may itself represent the ultimate waveshape to be reproduced, or may serve as a prototype for the formation of the ultimate (desired) waveshape by means of further signal processing operations on the stored waveshape.

Thus, U.S. Pat. No. 5,644,098, "Tone Signal Generator For Producing Multioperator Tone Signals, issued Jul. 1, 1997, and U.S. Pat. No. 5,665,929, "Tone Signal Generator For Producing Multioperator Tone Signals Using An Operator Circuit Including A Waveform Generator, A Selector And An Enveloper", issued Sep. 9, 1997, both to Crystal Semiconductor Corporation, describe waveform generators formed from a plurality of wavetables storing predefined shapes. Table selectors and waveshaping circuits operate on the wavetable outputs to provide a variety of signal shapes. Similarly, U.S. Pat. No. 5,604,323, "Musical Tone Electronic Synthesizer And Method", issued Feb. 18, 1997 to Ethymonics Ltd., describes a waveform generator formed from a plurality of wavetables, with at least a portion of the output of one wavetable being applied as a modulating input to another.

When using wavetable oscillators, it is generally necessary, or at least desirable, to further process the wavetable output even when the ultimate, desired shape is provided as output from the table, in order to introduce a variability and thus a richness to the sound. Thus, U.S. Pat. No. 5,541,354, "Micromanipulation of Waveforms In A Sampling Music Synthesizer", issued Jul. 30, 1996 to the International Business machines Corporation, describes a sample-based synthesizer in which the sound of a plurality of a given instruments is generated by applying a common sequence of sound samples of that instrument to a corresponding plurality of processors which introduce small-scale variations in amplitude or pitch to the samples so as to more realistically simulate a chorus of actual musical instruments.

While extremely useful, wavetables consume substantial memory. Although this is less of a problem now than formerly in light of the decreasing costs of memory, it still places basic limitations on the number of independent waveshapes that can practically be stored in memory on a given synthesizer. Thus, computational oscillators are often found to be desirable for creating various waveshapes, particularly those which are to serve as a basic or prototype wave that is to be further processed. These oscillators directly compute the waveform amplitude at each of a number of points (which may be thought of as instants in time), to thereby define the waveshape.

In employing computational oscillators, it is important that the oscillator operate efficiently. Despite significant increases in computing power with time, there is always more that is sought to be done in music synthesis than there is time to do it from a computational viewpoint, and thus oscillator efficiency may determinative of its usability in a particular instrument. Further, it is desirable that the oscillator provide a variety of waveshapes, and that these waveshapes offer a rich harmonic content.

SUMMARY OF THE INVENTION

In accordance with the present invention, we provide a computational oscillator that efficiently generates a variety of harmonically rich, dynamically variable waveshapes. Further, the waveshapes produced by the oscillator are smooth, i.e., have continuous first derivatives at each point. This is extremely valuable in music synthesis, and enables subsequent processing of the basic waveshapes without the introduction of aliasing which commonly results subsequent from subsequent signal processing operations such as multiplication. Such aliasing is generally audible to the listener, unless specific steps are taken to avoid it. For example, filtering can reduce or remove many non-linearities. However, such additional processing consumes additional time and system resources, and it is highly desirable to avoid it when possible, rather than attempt to compensate for it subsequently. Further, signals such as alias signals which are within the frequency band of interest cannot be removed without also removing signal desired components.

In addition to providing rich, continuous waveshapes, the oscillator of the present invention is dynamically variable under control of the user. Thus, during performance, the user not only can select among a wide variety of waveshapes, but can quickly vary the selection, and can further transition smoothly among them.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
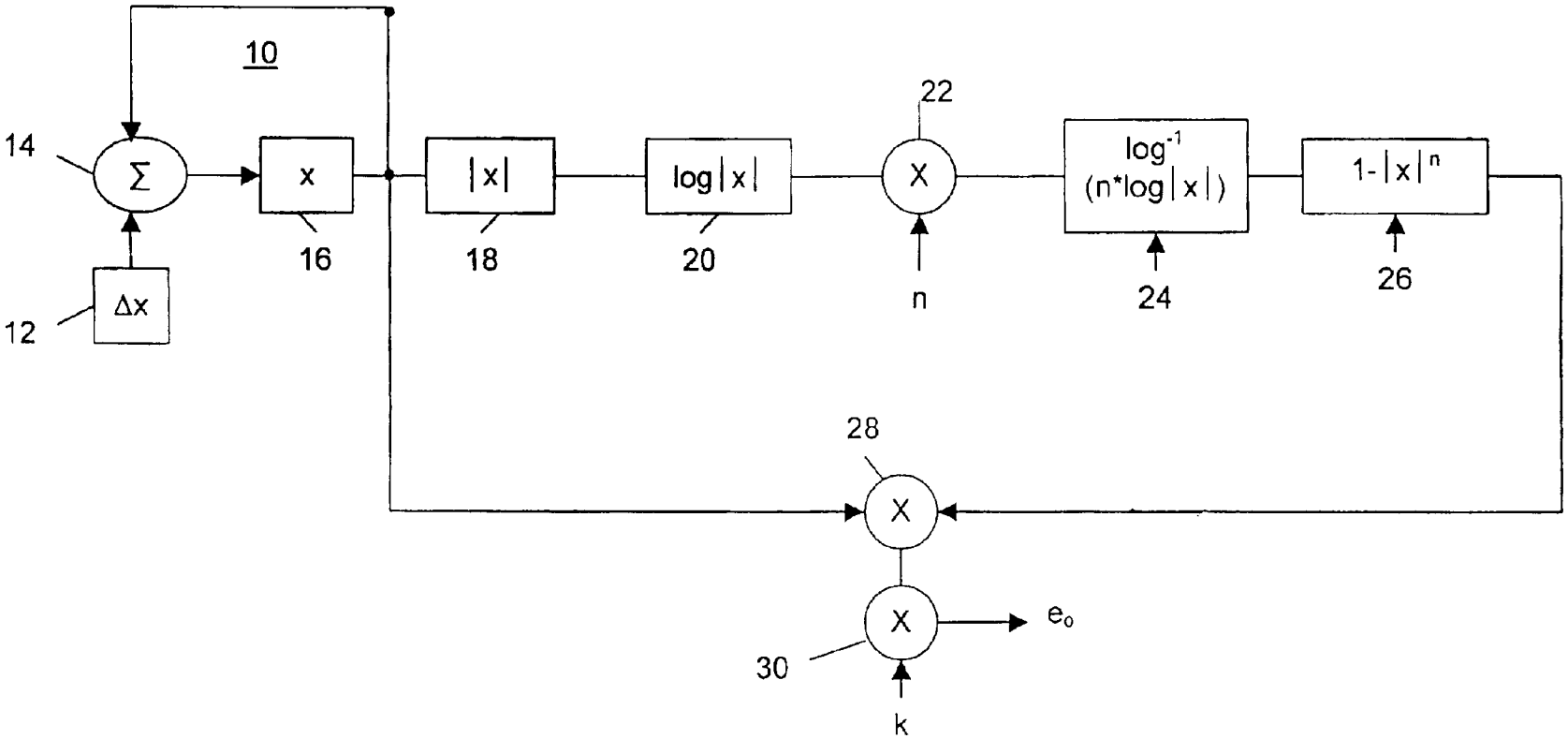
FIG. 1 is a block and line diagram of a preferred embodiment of an oscillator in accordance with the present invention.

In FIG. 1, an oscillator 10 in accordance with the invention includes a register 12 for receiving a phase increment $\Delta x$ of a phase x, $-1<=x<=1$. The increment $\Delta x$ is the fractional increment in phase per cycle of waveform, and defines the frequency f of the wave to be generated. Preferably, this increment is input by the user, for example, by means of control knobs, sliders, etc. on a musical synthesizer unit.

The register 12 also provides to a summer 14 an input from the previous value of a phase accumulator register 16. The summer adds the respective inputs (x and $\Delta x$) that are applied to it and provides an output to register 16 which holds the current phase x. The elements 12, 14 and 16 thus form a basic linear accumulator which generates a stepped ramp signal, $x_{n+1}=x_n+\Delta x$ whose repetition rate (frequency) is given by $f=SR/\Delta x$, where SR ("the sampling rate") is the rate at which the phase increments $\Delta x$ are applied to the summer; this type of ramp generator is known in the art. In high quality digital music systems, the sampling rate is typically 88 kHz.

The output of the phase accumulator register 16 is applied to an absolute value generator 18 which forms the absolute value, $|x|$, of the waveform parameter x. This is a well-known and simple mathematical operation which provides the magnitude of a signal independent of its sign. The log of this absolute value is then formed (20) and resultant value, $\log|x|$, is applied to a multiplier 22, in which it is multiplied by a control parameter, n, which defines the order of the specific waveshape to be generated. This parameter may be set by the user; may be fixed by the particular implementation; or may be controllable by other circuitry. The single multiplication in multiplier 22, using the log value for one of the inputs, replaces time-consuming multiplication operations that would otherwise be required for exponentiation, and enables real-time operation of the system.

The resultant product, $n*\log|x|$, where the asterisk (*) denotes multiplication, is applied as input to an antilog operator 24 which forms the product: $\text{antilog}(n*\log|x|)=|x|^n$. The latter value is subtracted from unity (block 26) to form $(1-|x|^n)$, and this in turn is multiplied by the phase value x in multiplier 28 to form the unscaled output, $y=x*(1-|x|^n)$.

The ability to process signals rapidly is critical in the operation of real-time systems. While operations such as addition can typically be performed relatively quickly in most systems, operations involving multiplication (e.g., multiplication, convolution, exponentiation, and the like) are much more time consuming, and can render impractical many otherwise desirable approaches to signal processing. Exponentiation is particularly demanding of processor resources, since it requires repeated multiplication, and possibly root extraction as well in the case of non-integer exponents. Thus, in the preferred embodiment of the present invention, we perform all necessary exponentiation by means of log/antilog operations, using a simple approximation that we have found to be appropriate under the circumstances and that is capable of generating the desired waveform in real time, that is, it produces the samples of the desired waveform at a given rate called "the sample rate". Further, it produces the waveform without audible discontinuities.

In particular, the log (base 2) of a number is formed herein by using the position of the leading digit of the number as a shift value, and the remainder of the number as an addend. Thus, to multiply the number 11 (base 10)=1011 (base 2) and 13 (base 10)=1101 (base 2), we take the position of the leading digit in the string 1011 (here, the leading digit is in the fourth digit position) and the position of the leading digit in the string 1101 (again 4). The shift value corresponding to the product of these numbers is thus 8 (4+8). We then add the remaining digits of the original numbers (the remaining digits being 011 and 101 in this example, and their sum being 1001) to obtain the result 10001001 whose value is 136 (base 10), a reasonable approximation to the correct value, 143. A similar approximation is made in forming the antilog. This facilitates real time operation of the oscillator.

It is desirable, and sometimes essential, to maintain a standard amplitude for the generated signal. This may be done, for example, by means of feedback control systems which maintain a substantially constant output over a wide range of variance of the input. However, we have found a simple scaling factor that maintains the generated waveform within the bounds $y=+/-1$ over the range of x. This scaling factor is a function of the waveshape parameter n only, and thus need be computed only once for a given waveshape. Specifically, the scaling factor is given by: $k=[(n+1)^{((n+1)/n)}]/n$. This factor is applied to multiplier 30, together with the output of multiplier 28, to form the final desired waveform $y=k*x*(1-|x|^n)$.

FIGS. 2A–2E are graphs of waveforms produced in accordance with the present invention. In each figure, the horizontal axis is the sample parameter x, while the vertical parameter is the amplitude, y, of the generated signal. Each of the figures was generated using a value $\Delta x=0.01$ for the phase increment.

Figure 2A:
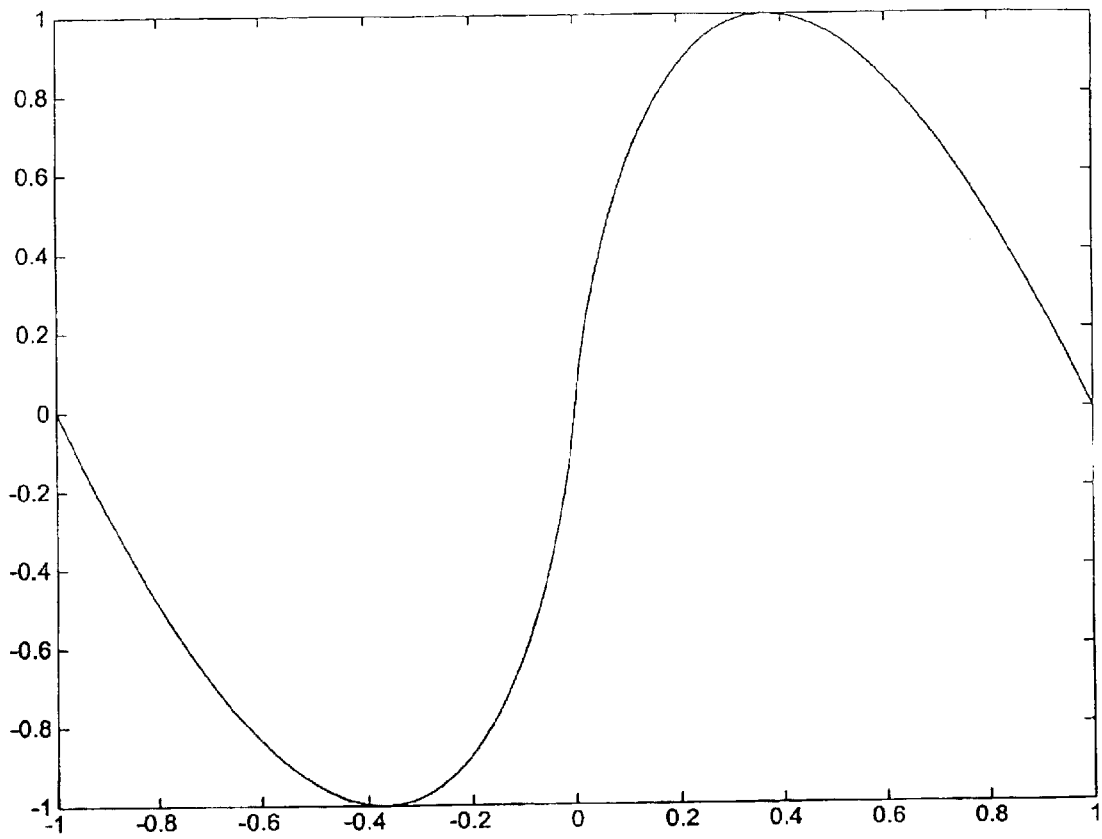
FIGS. 2A–2E are a representative collection of waveshapes produced by the oscillator of FIG. 1 invention responsive to dynamically selectable parameters.
Figure 2B:
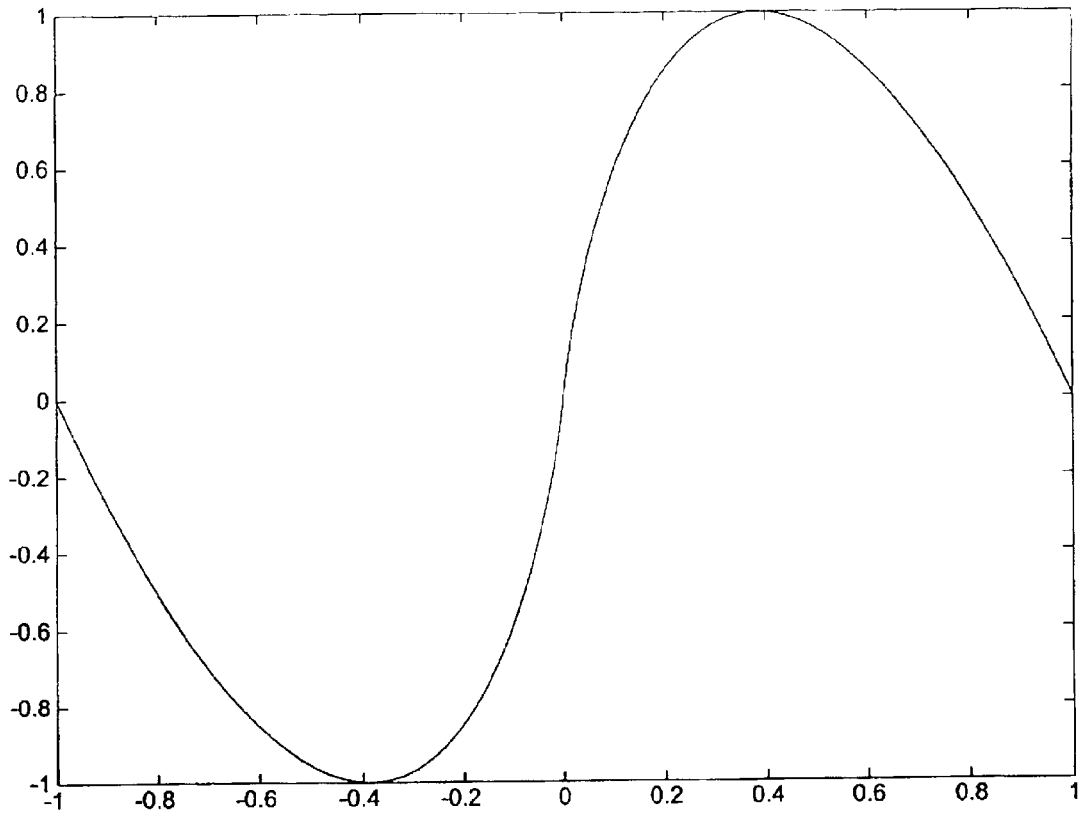

FIG. 2A corresponds to a waveshape parameter value n=0.01. The result is a waveform that is generally sinusoidal in shape, but slightly distorted. The distortion provides harmonics which are useful in creating interesting musical sounds. FIG. 2B corresponds to a waveshape parameter values n=0.1. The resultant waveform is similarly generally, sinusoidal, with slight distortion, providing useful harmonics for music creation.

Figure 2C:
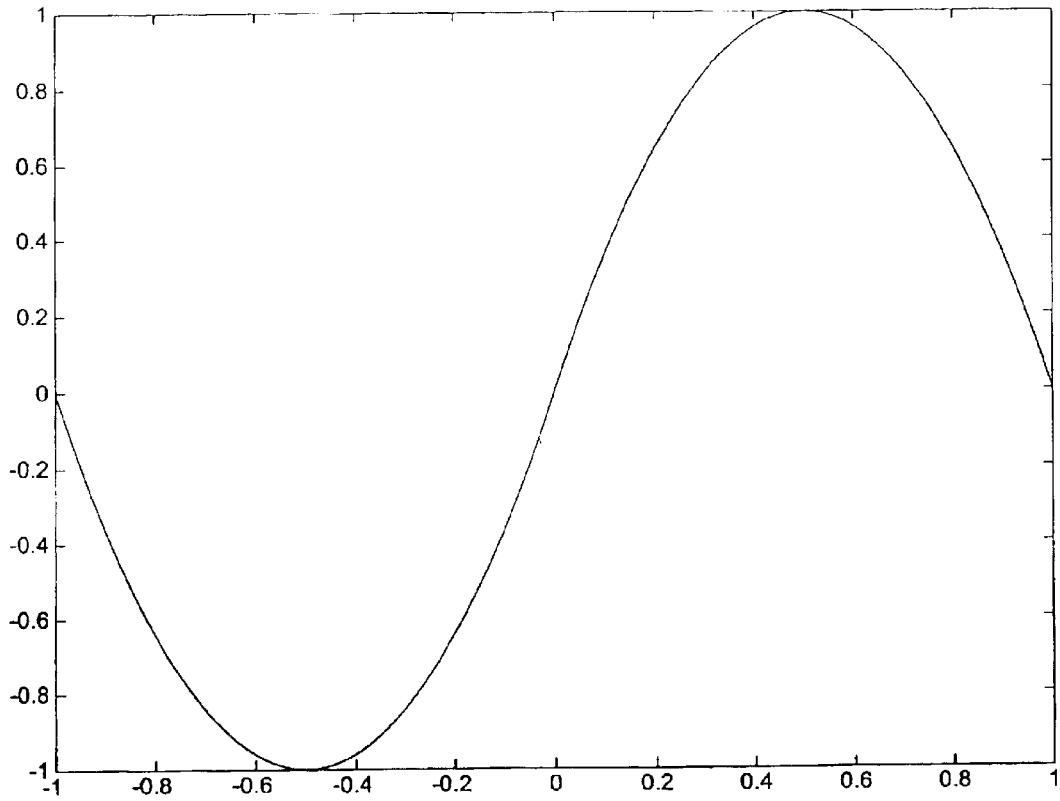
Figure 2D:
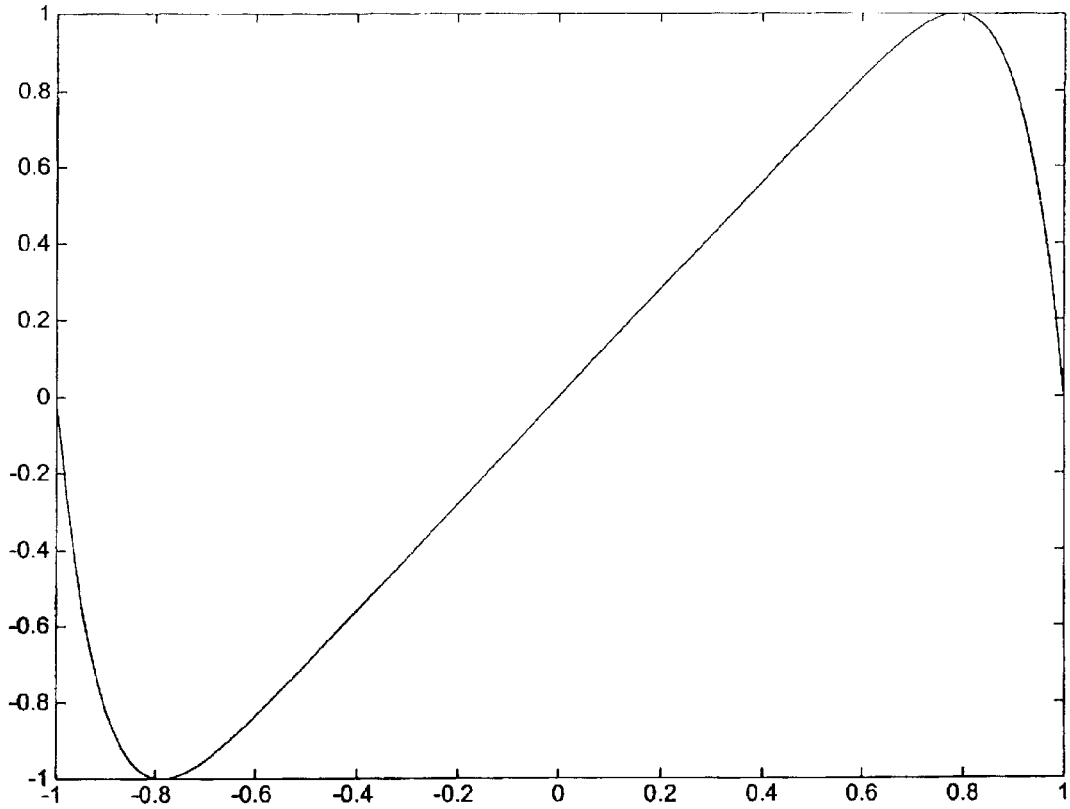
Figure 2E:
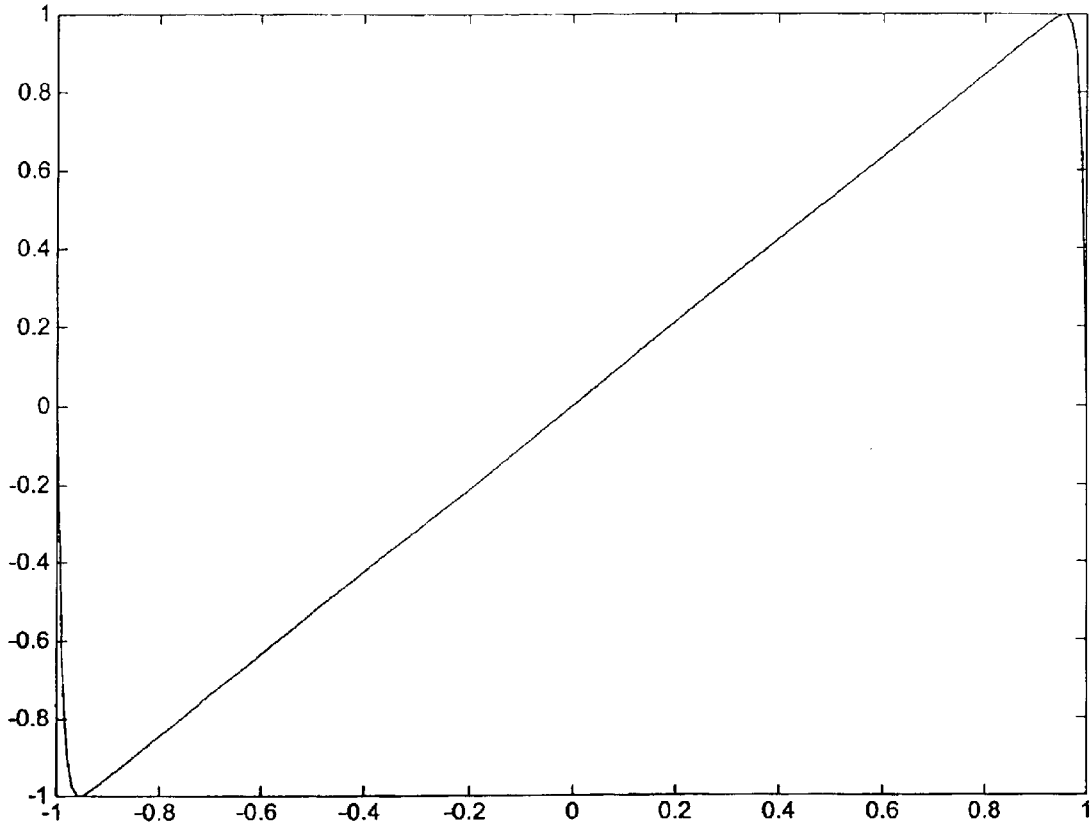

FIG. 2C corresponds to a waveshape parameter value n=1, and is very nearly a pure sinusoidal wave. In contrast, FIGS. 2D and 2E correspond to waveshape parameter values n=10 and n=100, respectively. As will be seen, the waveshapes become increasingly distorted (with respect to a pure sinusoid) as n is increased above the value n=1, and the harmonic content of the resultant waveshapes increases significantly. In all cases, however, the waveshapes are smooth and continuous, i.e., possess a continuous first derivative, without sudden jumps or other discontinuities. This is a valuable property of the oscillator of the present invention, since it greatly minimizes the creation of "aliases" which commonly arise from the high frequency components represented by discontinuities.

Figure 3:
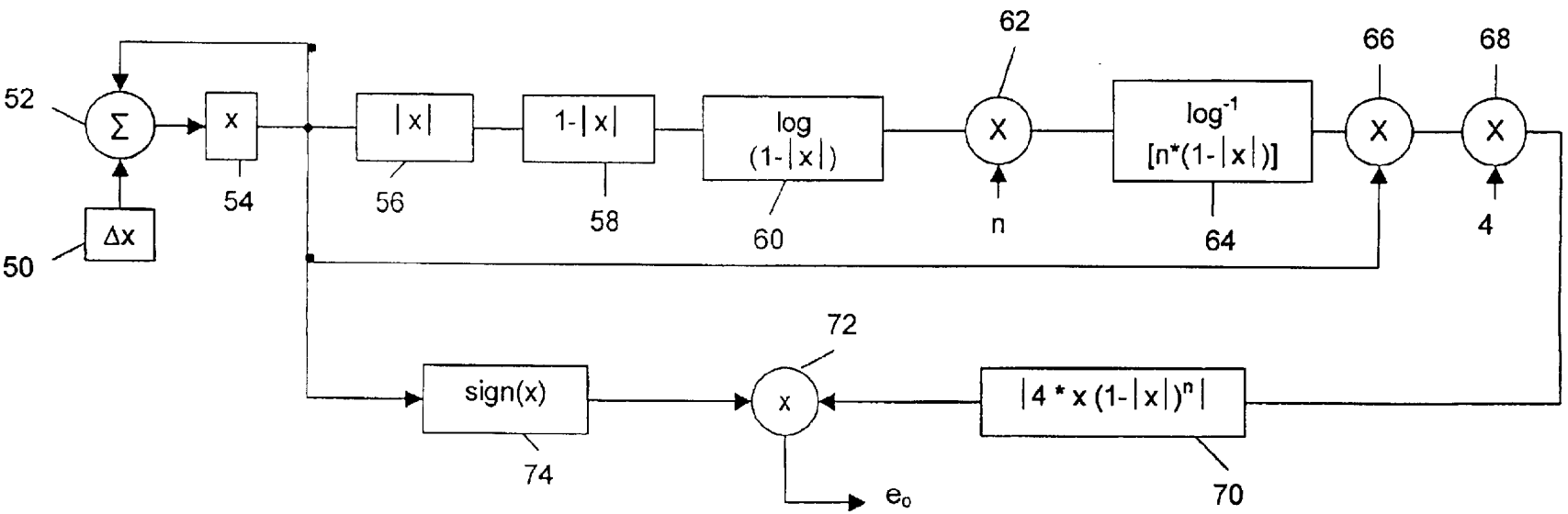
FIG. 3 is a block and line diagram of an alternative oscillator in accordance with the present invention.

FIG. 3 shows an alternative embodiment of the present invention which also creates smooth, continuous, dynamically controllable waveforms that are rich in harmonics to varying degrees. In FIG. 3, a phase increment register 50, loaded by the user with a phase increment Δx, supplies the increment to a summer 52 which also receives an input from a phase accumulator register 54 and adds the two together. The result is stored in register 54 as the current phase. The absolute value |x| of this phase is next formed (56) and subtracted from unity (58) to form the value (1−|x|). The log of (1−|x|) is next formed (60) and the resultant is multiplied in a multiplier 62 by a factor of "n", where "n" is the order of the waveform to be generated. The antilog of the product is next formed (64), to produce $(1-|x|^n)$. This value is multiplied by the phase increment x in a multiplier 66, and the resultant is in turn multiplied by the constant "4" in a multiplier 68. The absolute value of this product, $|4*x*(1-|x|)^n|$, is then formed (70), and is in turn multiplied in multiplier 72 by the signum function of x, sign(x) (74) to form the desired output, $y=\text{sign}(x)*|4*x*(1-|x|)|^n$. The signum function has the value +1 when x is positive, and −1 when x is negative.

Figure 4A:
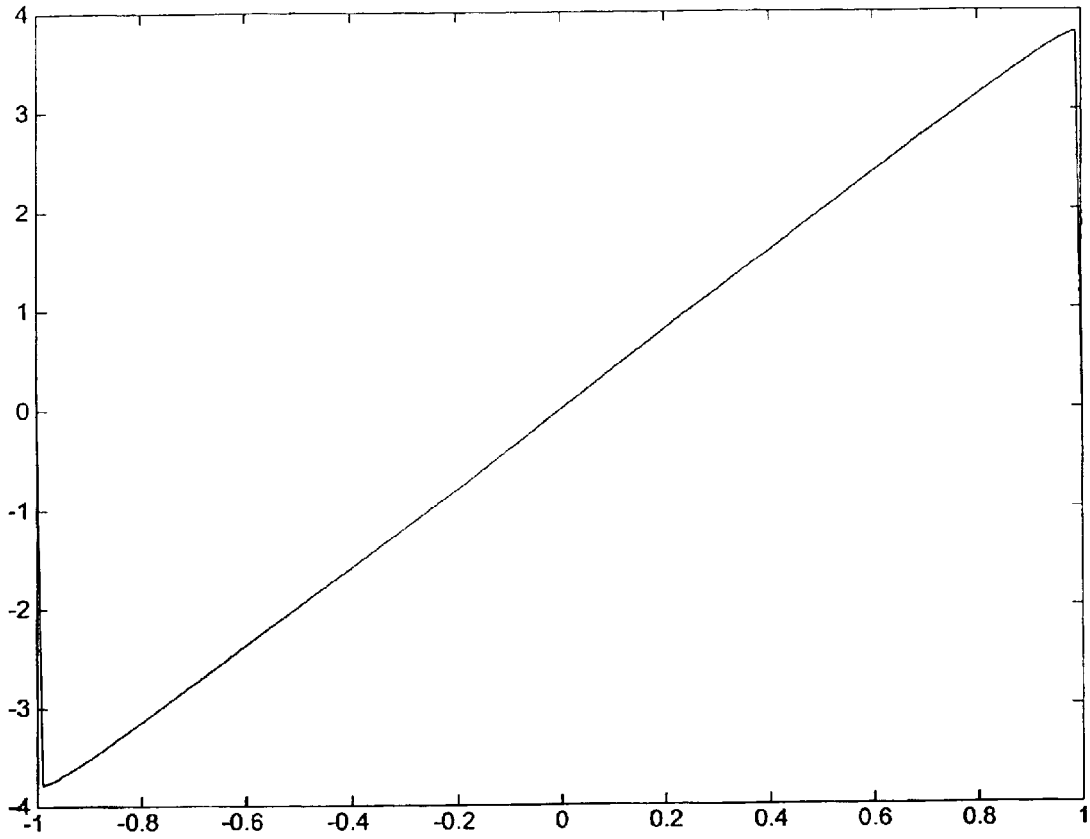
FIGS. 4A–4E depict a representative collection of waveshapes produced by the oscillator of FIG. 3.
Figure 4B:
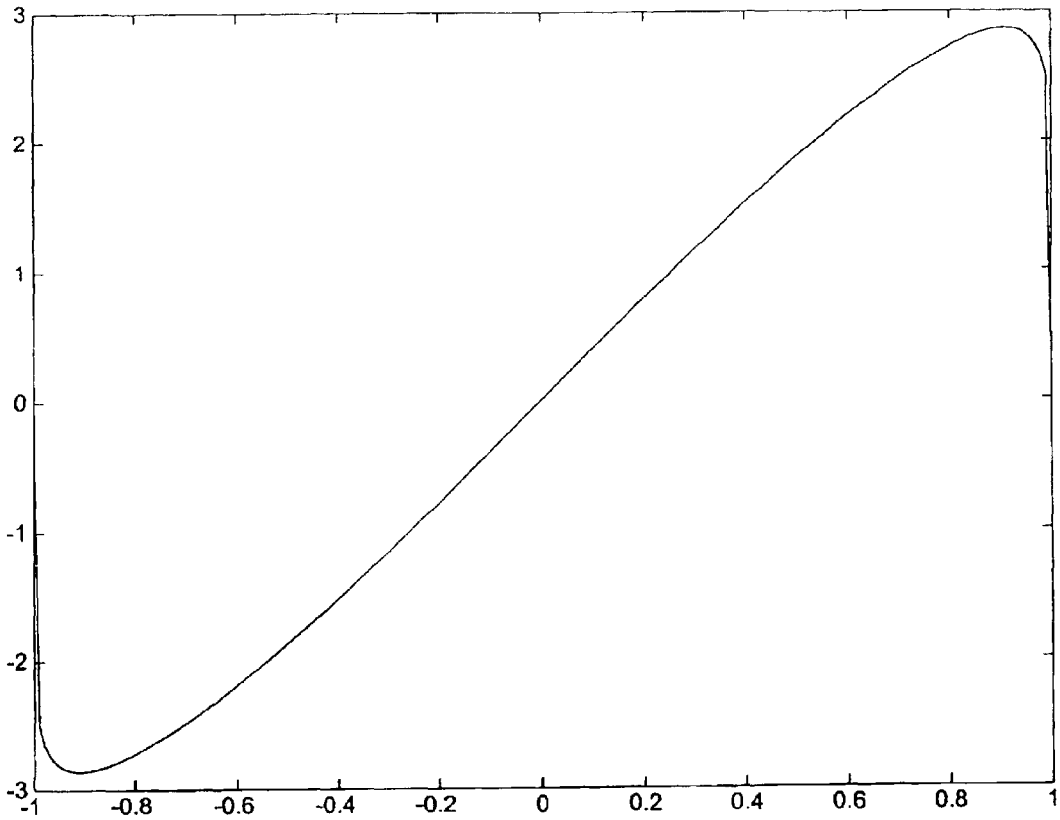
Figure 4C:
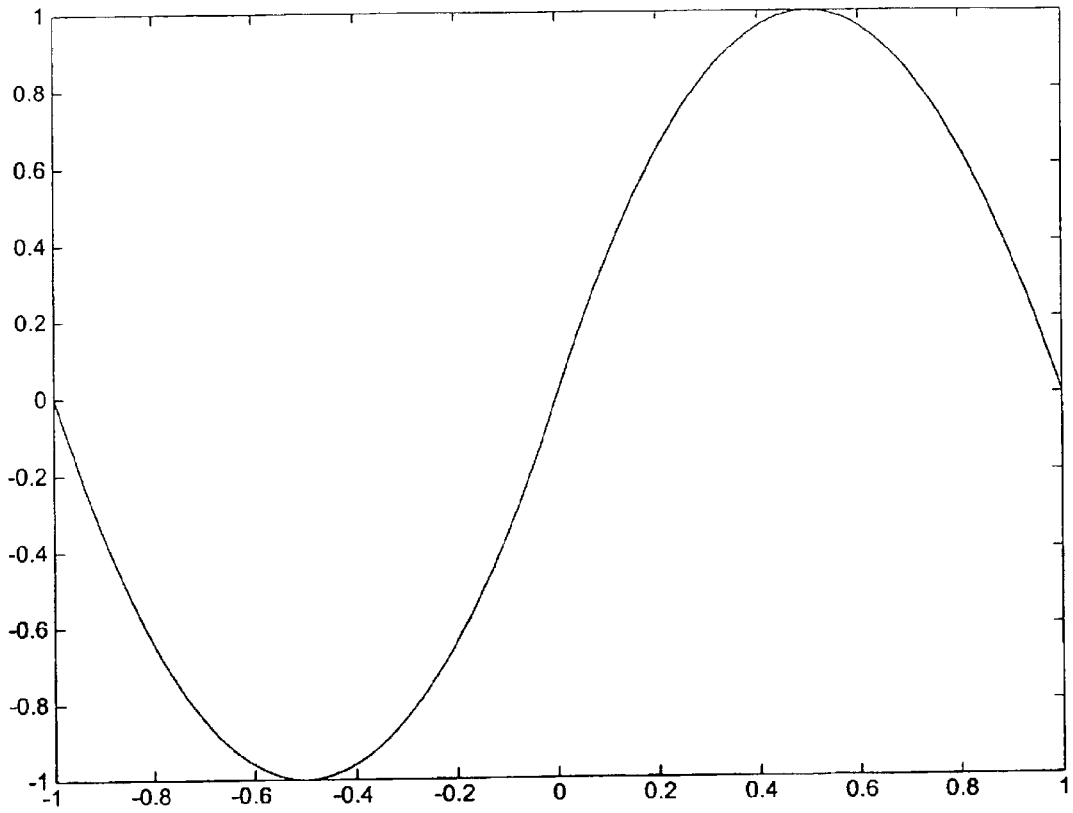
Figure 4D:
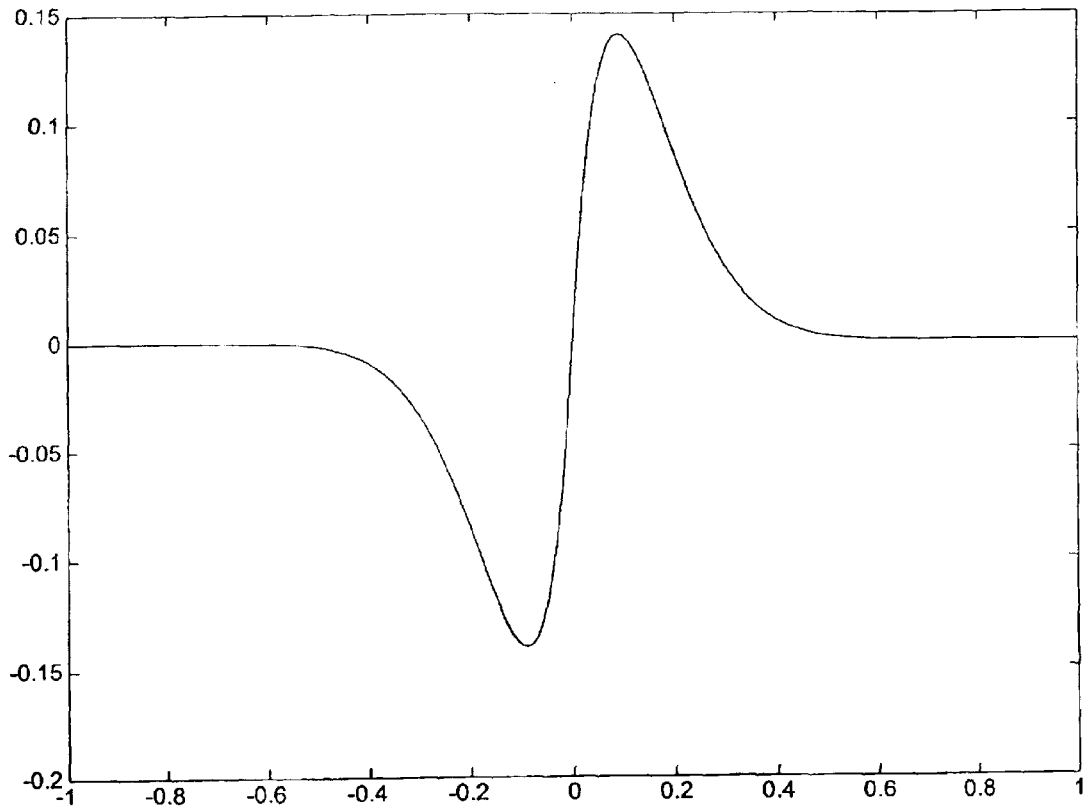

FIGS. 4A–44E show the resultant waveforms for various values of the waveshape parameter, n, over a range of −1<=x<=1. Each figure was generated using a waveform phase increment increment of 0.01. In FIG. 4A, with a waveshape parameter of n=0.01, the resultant waveform is of a generally sawtooth shape, with steep slope at the beginning and end of the interval, and a smooth ramped slope in between. This waveform has significant high frequency harmonics. The transition between the beginning and end portions, on the one hand, and the center portion on the other, are rapid but continuous. In FIG. 4B, corresponding to a waveshape parameter value n=0.1, the transition is much more gradual and thus smoother; the waveshape is otherwise similar to that of FIG. 4A. In FIG. 4C, corresponding to a waveshape parameter value n=1, the waveform has become nearly perfectly sinusoidal, with little harmonic content beyond the fundamental.

Figure 4E:
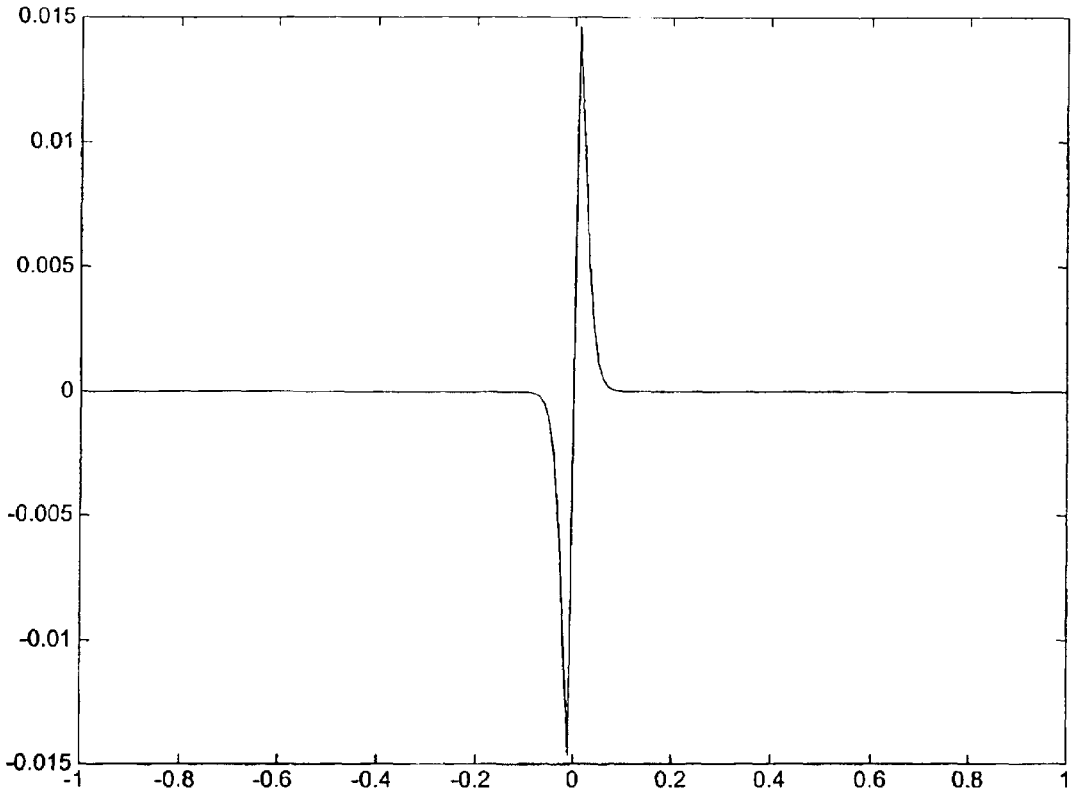

As n increases, the departure from a pure sinusoid again becomes more pronounced. Thus, in FIG. 4D, corresponding to a waveshape parameter value n=10, the waveshape is relatively quiescent at its outer ends but varies rapidly in the central portion. In FIG. 4E, corresponding to a waveshape parameter value n=100, the fluctuations in the waveshape are confined to an even narrower central portion of the waveform.

However, all waveforms remain continuous, and the transition from one waveform to another is smooth as one varies the waveform parameter n. It should be noted that the value n may be any real number, rational or irrational. It will be noted that in this embodiment, the scaling factor is simply the number "4".

The oscillators of the present invention may readily be implemented in hardwired circuits; in digital signal processing (DSP) circuitry, using microcode for control and arithmetic operations; and in software in general purpose digital computers, among other implementations. With these oscillators, one can produce smooth waveshapes in real time suitable for further processing consistent with a conventional sampling rate of 44.1 kHz or the like. The waveshapes can be dynamically controlled and changed by the user by means of selecting and changing the waveshape parameter n, as desired, without producing discontinuities which lead to audible aliasing. The resultant waveshapes are varied, and rich in harmonic content.

It will be understood that the foregoing is illustrative only, and that various changes may be made consistent with the spirit and scope of the invention, the latter being defined with particularity in the claims.

What is claimed is:

1. An oscillator for generating waveforms for use in digital musical synthesis, comprising:

a register for storing a waveform phase increment (Δx);

a programmed digital signal processor configured to receive Δx and a waveform shape parameter (n), and including arithmetic and control circuitry adapted to generate a waveform whose waveshape is defined by the function $f(x)=k*x*(1-|x|)^n$, where k is a scaling factor, and where x is the value from a linear accumulator of Δx.

2. An oscillator according to claim 1 in which the phase x corresponding to the phase increment Δx is bounded by the range −1<=x<=1.

3. An oscillator according to claim 1 in which said scaling factor is given by $k=(n+1)^{(n+1)/n}/n$.

4. An oscillator according to claim 1 in which said waveform shape parameter n varies over a range of from less than 1 to greater than 1.

5. An oscillator according to claim 4 in which said waveform shape parameter n varies over a range of from 0.001 to 1000.

6. An oscillator according to claim 1 arranged to perform the exponentiation of (1−|x|) by means of log and antilog operations.

7. An apparatus for generating smooth, dynamically variable waveforms of varied harmonic content for use in digital musical synthesis, comprising:

A. means for forming a waveform parameter (x), x responsive to receipt from a register, of a waveshape parameter increment (Δx), where x is equal to the sum of Δx and x;

B. means for receiving a waveform shape parameter (n), n defining a waveshape to be generated; and C. means for generating a waveform whose waveshape is defined by the function $f(x)=k*x*(1-|x|)^n$, where k is a scaling factor.

8. An oscillator according to claim 7 in which said parameter x is bounded by the range $-1<=x<=1$.

9. An oscillator according to claim 7 in which said scaling factor is given by $k=(n+1)^{(n+1)/n)}/n$.

10. A method of generating dynamically variable waveforms for use in digital music synthesis, comprising the steps of:

A. forming a waveform parameter (x), x responsive to specification of a waveform parameter increment, Δx;

B. receiving a a waveform shape parameter (n), n defining a waveshape to be generated;

C. generating a a waveform whose waveshape is defined by $f(x)=k*x*(1-|x|)^n$, where k is a scaling factor.

11. An oscillator for generating waveforms for use in digital musical synthesis, comprising:

a register for storing a waveform phase increment Δx;

a programmed digital processor configured to receive Δx and a waveform shape parameter n, and including arithmetic and control circuitry adapted to generate a waveform whose waveshape is defined by the function $f(x)=\text{sine}(x)*|4*x*(1-|x|)^n|$, where x is the value from a linear accumulator of Δx.

12. An oscillator according to claim 11 in which the phase x corresponding to the phase increment Δx is bounded by the range $-1<=x<=1$.

13. An oscillator according to claim 11 in which said waveform shape parameter n varies over a range of from less than 1 to greater than 1.

14. An oscillator according to claim 13 in which said waveform shape parameter n varies over a range of from 0.001 to 1000.

15. An oscillator according to claim 11 arranged to perform the exponentiation of the factor $(1-|x|)$ by means of log and antilog operations.

16. An oscillator according to claim 15 in which log and antilog operations are performed by using the position of the leading digit in numbers to be involved in the log or antilog operation as a shift factor and using the remaining digits as addends.

17. Apparatus for generating smooth, dynamically variable waveforms of varied harmonic content for use in digital musical synthesis, comprising A. means for forming a waveform parameter (x), x responsive to receipt from a register of a waveshape parameter increment (Δx), where x is equal to the sum of Δx and x;

B. means for receiving a waveform shape parameter (n), n defining a waveshape to be generated; and C. means for generating a waveform whose waveshape is defined by the function $f(x)=\text{sine}(x)*|4*x*(1-|x|)^n|$.

* * * * *